US008876520B2

(12) United States Patent
Gallagher

(10) Patent No.: US 8,876,520 B2
(45) Date of Patent: Nov. 4, 2014

(54) FABRIC WRAP

(76) Inventor: Christopher G. Gallagher, Baltimore, MD (US)

( * ) Notice: Subject to any disclaimer, the term of this patent is extended or adjusted under 35 U.S.C. 154(b) by 536 days.

(21) Appl. No.: 13/159,817

(22) Filed: Jun. 14, 2011

(65) Prior Publication Data

US 2011/0305408 A1 Dec. 15, 2011

Related U.S. Application Data

(60) Provisional application No. 61/354,320, filed on Jun. 14, 2010.

(51) Int. Cl.

| | |
|---|---|
| ***B29C 53/04*** | (2006.01) |
| ***B29C 59/04*** | (2006.01) |
| ***B65D 33/28*** | (2006.01) |
| ***B65D 65/22*** | (2006.01) |

(52) U.S. Cl.

CPC ..... *B65D 33/28* (2013.01); *B65D 65/22* (2013.01)

USPC ..... 425/335; 425/363; 425/371; 264/299; 29/419.1

(58) Field of Classification Search

USPC ..... 425/335, 363–375; 229/87.19; 29/419.1; 72/57, 421, 196; 264/299

See application file for complete search history.

(56) References Cited

U.S. PATENT DOCUMENTS

| | | | | |
|---|---|---|---|---|
| 5,714,738 | A * | 2/1998 | Hauschulz et al. | 264/299 |
| 5,887,470 | A * | 3/1999 | Mirtsch | 72/57 |
| 7,014,450 | B2 * | 3/2006 | Bergsma et al. | 425/363 |
| 7,846,287 | B2 * | 12/2010 | Bergsma et al. | 156/218 |

* cited by examiner

*Primary Examiner* — Joseph S Del Sole
*Assistant Examiner* — Thukhanh Nguyen
(74) *Attorney, Agent, or Firm* — Michael Best & Friedrich LLP

(57) ABSTRACT

A dimpled fabric creation system and method is provided to form a dimpled fabric using a mold or machine having a plurality of protrusions and grooves, while avoiding the repetitive steps to manually shape each protrusion individually by tying portions of fabric individually. The protrusions may be of complex three dimensional shapes to form dimples in the fabric having corresponding complex three dimensional shapes. The system and method provide for creation of a dimpled fabric container, wherein the dimpled fabric container may be utilized in gift wrapping.

1 Claim, 14 Drawing Sheets

500
520
525
525
525

FABRIC WRAP

CROSS-REFERENCE TO RELATED APPLICATIONS

This application claims priority to U.S. provisional application Ser. No. 61/354,320 filed Jun. 14, 2010, which is incorporated herein by reference in its entirety.

TECHNOLOGY FIELD

The present invention relates generally to a dimpled fabric, and more particularly to methods for making dimpled fabric and dimpled fabric gift wrap, including dimpled fabric with complex dimpled fabric protrusion designs.

BACKGROUND

"Popcorn" fabric is a reversibly expandable fabric that has a plurality of dimples (also referred to as puckers) to provide its reversibly expandable feature. Popcorning fabric allows inexpensive fabric to expand more than the limited two times expansion of more expensive fabric materials like Spandex. Expanding at least three times its initial size can allow a garment made using this technique to be one-size-fits-all. The ability to expand that much is currently only achieved using skilled craftsperson to make the hundreds of "popcorn" dimples in the fabric.

Traditional methods of creating popcorn fabric are to cut a bolt of fabric into individual garment shapes and sew each garment prior to adding the puckers that allow the garment to expand. Garments are sewn prior to making puckers simply because the expansion of the puckered fabric in any direction would make sewing very difficult. Using this conventional method, garment workers gather each individual portion of the fabric to make each pucker around a thin tool or finger of the worker. The worker then takes a thread and loops it tightly around the base of the newly created fabric pucker. When the thread loop is very tight, the worker withdraws the tool and pushes it into the fabric adjacent to the first pucker to create another pucker using the same method. This leads to a plurality of individual puckers secured by tightly drawn thread loops at the base of each pucker in the fabric. The hand movements of the worker is not dramatically different from hand movements used in crocheting fabric. Puckers in the fabric are added one at a time.

The thread bound fabric is then treated using steam and pressure in a pressure cooker so the fabric is permanently set to keep puckers in the fabric. Then the single thread that secures all of the puckers in each garment is pulled until it unwinds its way all the way back to where the first pucker had been tied. This knot is removed and the dimpled fabric is put into a bath solution to soften the fabric. The result is a fabric having a plurality of reversibly expandable dimples. When stretched, the dimpled fabric can readily expand up to three times or more its relaxed or un-stretched width or size. In its relaxed state the fabric returns to its smaller size, showing the dimples in their largest size. Conventional dimples are often round-ended, cylindrical shaped, resembling to the shape of a garment worker's tool, or finger, around which the fabric is wound.

A major shortcoming of the "popcorn" technique is that the fabric garment must be sewn prior to the "popcorning" process because trying to sew fabric that has been popcorned is tremendously difficult as it can expand or contract in any direction. Sewing each garment prior to popcorning has meant that up until now, putting the hundreds of popcorn puckers into each garment has been done only by hand, one garment at a time. This conventional methodology for creating popcorn fabric imposes numerous man hours to form popcorn shaped structures in the fabric and is thus inefficient. Each popcorned fabric has been the result of extensive hand craftsmanship by individual artisans, mostly in China, using a production method called "distributed manufacturing". In this process pre-sewn garments are distributed throughout a village so each garment can be sewn into puckers by hand to prepare it for treating.

The conventional methodology does not provide for more complex detailed popcorn structure nor for a process to create fabric popcorn structures on an object such as a bag. A serious problem with conventional popcorned fabric, utilized in for example a bag, is that it imparts no structure to the bag so that, for example, a popcorned handbag looks good until a cell phone is dropped inside causing the bag to droop down to very nearly the full extension of the bag. This shortcoming dramatically limits the value of a "popcorn" fabric bag, which is why they have never enjoyed the widespread popularity of popcorned garments.

A creative challenge is that 2.6 billion dollars a year in paper gift wrap is discarded in the United States. This means a staggering volume of trees need to be harvested and processed into gift wrap in order to satisfy the US appetite for gift wrap. Unfortunately, the gift wrap is discarded almost immediately after gifting. As a result, huge volumes gift wrap become a part of our post holiday refuse stream and what were previously carbon absorbing, living trees become landfill.

The major alternative to paper gift wrap, is paper "gift" bags. In each case the paper provides little if any durability for re-use. Craft wraps using a variety of materials including recycled comic pages, family photos, artificial flowers, aluminum foil and other materials have represented a very small section of the gift giving market.

In searching for alternative fabric gift wrap solutions to satisfy the majority of United States consumers in a production offering, Spandex and other expanding elastic based fabric materials have three major drawbacks: the first drawback is the high cost of the elastic fabric; the second drawback is that elastic materials typically expand only two times their initial size so dozens of elastic bags would be needed to cover any reasonable range of gift sizes, making it confusing for consumers to select the correctly sized fabric bag for their gift and severely limiting the size range a gift could be purchased to ever use that fabric gift bag again; finally, Spandex and other elastic materials tend to be form fitting and would hold to the wide cross section of a gift while sagging around other portions of a non-geometric or tapered form such as a football.

What is needed is an improved system and method for manufacturing dimpled fabric having a plurality of reversibly expandable dimples. What is also needed is an improved system and method for manufacturing dimpled fabric having detailed and complex shaped dimples. What is also needed is an improved system and method for forming dimples in fabric formed as containers or bags. What is also needed is a dimpled fabric gift wrap that does not have the shortcomings of not conforming to the contents within the bag nor incurs sagging around the contents. As gift wrap made of dimpled fabric to accommodate a wide range of gift sizes and shapes, with an opening that is quick and easy to open and close, the dimple fabric gift wrap can provide an ideal alternative to the time consuming and wasteful practice of using and discarding paper gift wrap products and ribbons. By using and re-using the fabric gift wrap environmental protection may be afforded.

SUMMARY

Embodiments of the present invention address and overcome one or more of the above shortcomings and drawbacks, by providing systems and methods for creating dimpled fabric. This technology is particularly well-suited for, but by no means limited to, varying the three dimensional shape of a dimple on the dimpled fabric. In addition, creating dimples in items such as containers, pouches or bags, for example, for gift wrapping is also provided.

Embodiments of the present invention are directed to a gift wrap including a dimpled fabric pouch. The dimpled fabric pouch includes a bottom, one or more sidewalls, and an opening opposite the bottom. A plurality of dimples are located on the one or more sidewalls and bottom of the dimpled fabric pouch portion. The dimpled fabric pouch is reversibly expandable to take the shape of an object disposed therein. The gift wrap further includes a closure system, located about a periphery of an opening of the dimpled fabric pouch, connected to the sidewalls of the dimpled fabric pouch located below the periphery of the opening. The closure system expands to widen the circumference of the opening and retracts to shrink the circumference of the opening above the object disposed in the dimpled fabric pouch. The gift wrap further includes a fabric portion extending above the closure system. The fabric portion extends away from the object disposed in the dimpled fabric pouch and does not take the shape thereof an object disposed in the dimpled fabric pouch.

According to one embodiment of the invention, the closure system includes a passageway around the periphery of the opening and one or more drawstrings. The one or more drawstrings are located through at least a portion of the passageway around the periphery of the opening and are exposed from within the passageway in two opposing locations about the periphery of the opening from the passageway at one or more holes on the passageway. According to one aspect of one embodiment of the invention, the one ore more drawstrings may be pulled at the one ore more holes where the one or more drawstrings are exposed from within the passageway to shrink the circumference of the opening. According to another aspect of one embodiment of the invention, the one or more drawstrings may be extended from the one or more holes where the one or more drawstrings are exposed from within the passageway, around the sidewalls of the dimpled fabric pouch to connect at the bottom of the dimpled fabric pouch to resemble a wrapped gift. According to another aspect of one embodiment of the invention, the the fabric portion is dimpled. According to another embodiment of the invention the plurality of dimples includes one of: geometric shapes, humanoid figure shapes, animal shapes, letters, or numbers.

Embodiments of the present invention are directed to a dimpled fabric generation system including a dimple forming mechanism. The dimple forming mechanism includes a plurality of protrusions on and extending from a surface of the dimple forming mechanism. The protrusion comprises a base in contact with the surface of the dimple forming mechanism, at least one side wall extending from the base, and a top end portion located at a distal end of the at least one side wall. The dimpled fabric generation system further includes a fabric to position on at least a portion of the surface of the dimple forming mechanism and at least a portion of the plurality of protrusions on the at least a portion of the surface of the dimple forming mechanism. The dimpled fabric generation system further includes a fitting device to apply the fabric to the dimple forming mechanism. The fitting device fits the fabric on to the surface of the dimple forming mechanism and around the at least a portion of the plurality of protrusions of the dimple forming mechanism.

According to one embodiment of the invention, the dimple forming mechanism is a mold. According to another embodiment of the invention, the fitting device is a wrap applicator. The wrap applicator includes one of: shrink wrap or heat-shrink tubing. According to one aspect of one embodiment of the invention, the dimpled fabric generation system further includes a heater for applying heat to the wrap applicator. The application of heat from the heater shrinks the wrap applicator to fit the fabric onto the surface of the mold and around the plurality of protrusions on the surface of the mold.

According to another embodiment of the invention, the dimpled fabric generation system further includes a cord fastener for binding the wrap applicator to the fabric and the fabric to the surface of the mold. According to another embodiment of the invention, the fitting device is a cord fastener.

According to another embodiment of the invention, the dimple forming mechanism comprises a sufficient number of protrusions for forming the fabric dimples in the fabric simultaneously and to increase the stretch factor capability of the fabric by at least two times. According to one aspect of one embodiment of the invention, the protrusions are arranged on the surface of the apparatus in an array.

According to another embodiment of the invention, the dimple forming mechanism includes a rotary belt having the plurality of protrusions extending radially from the rotary belt. The fitting device includes a blade rotary device, a plurality of ribs; and one or more ridges. The blade rotary device feeds the fabric under the plurality of ribs, and over ridges to create folds in the fabric and the blade rotary device compresses the fabric positioned over the plurality of protrusions perpendicular to the direction of the folds to conform the fabric around the plurality of the protrusions.

Embodiments of the present invention are directed to a method for creating dimpled fabric including providing a mold. The mold comprises a surface, a plurality of protrusions extending from the surface, and a plurality of grooves formed in the space between the protrusions. The method for creating dimpled fabric further includes wrapping the mold with a fabric and extending the fabric on to the surface of the mold, around the protrusions, and in to the grooves. A plurality of valleys are space in the surface of the fabric located over the grooves. The method for creating dimpled fabric further includes fitting the fabric around the protrusions, in to the grooves, and on to the surface of the mold. The method for creating dimpled fabric further includes setting dimples in the fabric where the fabric is extended by the plurality of protrusions. The method for creating dimpled fabric further includes removing the dimpled fabric from the mold. The dimples are permanently and reversibly expandably set in the fabric.

According to one embodiment of the invention, fitting the fabric further includes binding the fabric to the mold with a cord fastener wrapped in one or more of the valleys. According to another embodiment of the invention, fitting the fabric further includes wrapping a heat sensitive wrap applicator around the fabric wrapped around the mold and applying heat to the heat sensitive wrap applicator wrapped around the fabric to shrink the heat sensitive wrap applicator onto the fabric to fit the fabric around the protrusions, into the grooves, and onto the surface of the mold. According to one aspect of one embodiment of the invention, applying heat to the heat sensitive wrap applicator further includes heating the heat sensitive wrap applicator at a specified temperature and for a specified amount of time in order to permanently set the dimples in the fabric. The dimples are reversibly expandable as the fabric expands between a relax state and an expanded state. According to another aspect of one embodiment of the invention, the method for creating dimpled fabric further includes removing the heat sensitive wrap applicator from the fabric before removing the dimpled fabric from the mold.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF ILLUSTRATIVE EMBODIMENTS

The problems in the prior art have motivated the creation of a system and method for making dimpled fabric more efficiently by avoiding the repetitive steps involved in the conventional practice of manually creating each individual dimple of a popcorn fabric by hand. Embodiments of the present invention provide a mold and machine having a plurality of protrusions that allow for the simultaneous formation of a plurality of dimples in the fabric. Embodiments of the system and method also provide for the creation of more intricate dimples, such as three dimensional shaped dimples in the fabric. Further embodiments provide for the creation of dimples in a fabric formed as a container or bag for utilization in activities such as gift wrapping, for example.

Figure 1:
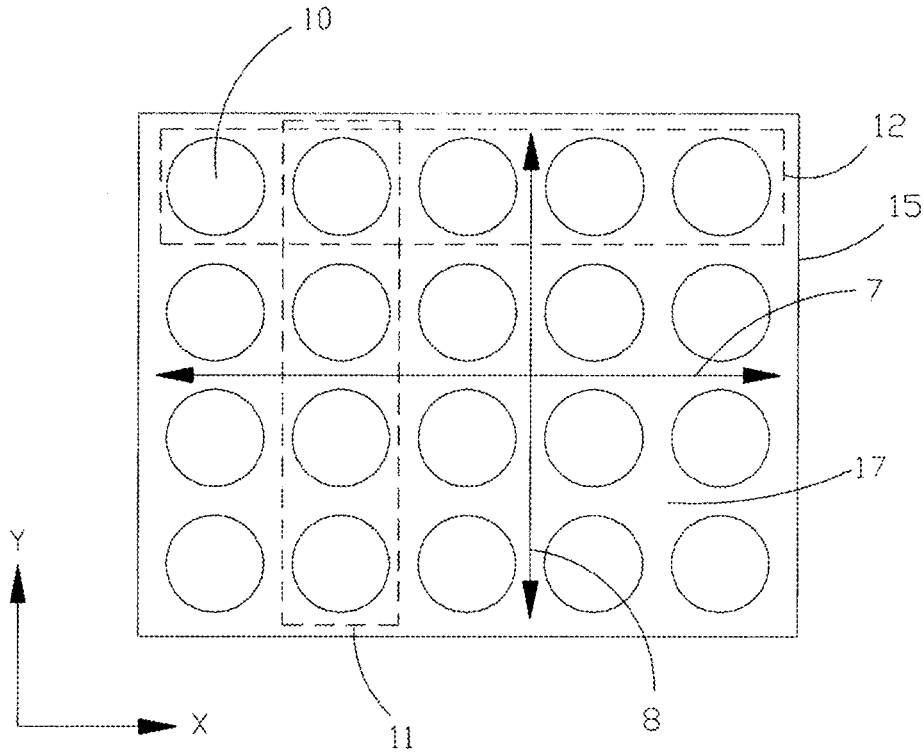
FIG. 1 shows a top-down perspective view of a patch of fabric having numerous fabric dimples.

FIG. 1 shows a patch of dimpled fabric having a plurality of dimples. The fabric having the plurality of dimples has two sides. The dimple is defined by a fabric protrusion and pocket. The dimple on one side of the fabric is defined as a pocket or cavity (see FIG. 2A). The other side of the fabric defines the dimple by a protrusion in the fabric having a side wall extending away from the un-dimpled portion of the fabric (e.g. a base) to a raised distal end portion.

As shown in FIG. 1, the top portion of each fabric dimple 10 is visible, as extending into the foreground above the planar fabric surface 15 in this top-down perspective view. In some embodiments, the fabric dimples 10 may be arranged in columns of fabric dimples 11 and rows of fabric dimples 12, as shown in FIG. 1, such that vertical fabric valleys 8 extend between columns of fabric dimples 11 in direction Y and horizontal fabric valleys 7 extend between rows of fabric dimples 12 in direction X. In other embodiments, the fabric dimples 10 are arranged randomly—i.e., they are not aligned in straight columns and rows.

Figure 2A:
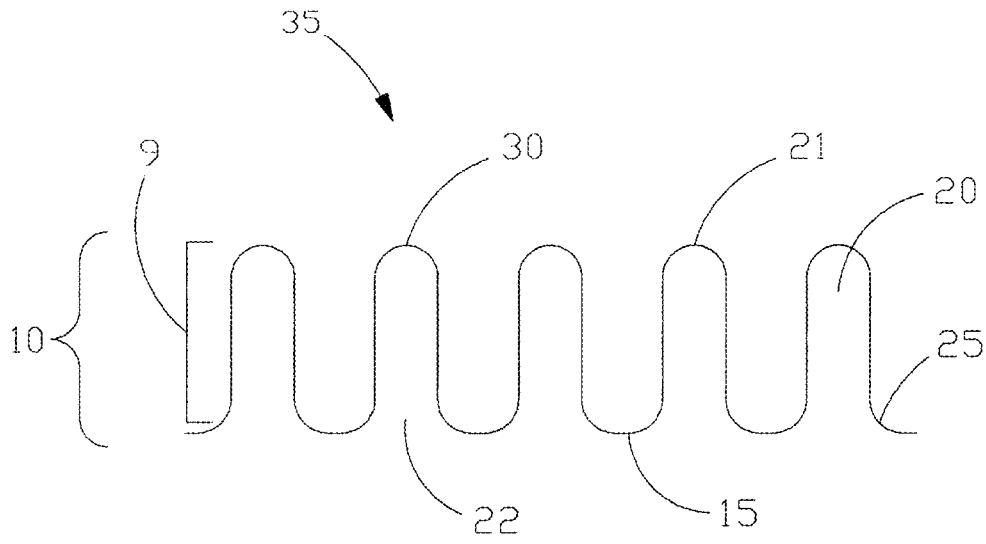
FIG. 2A shows a side view splice of a series of exemplary cylindrical fabric dimples.

FIG. 2A shows a side view splice of a series of cylindrical fabric dimples 35. The series of cylindrical fabric dimples 35 may exemplify either a row or column of cylindrical fabric dimples 30. The dimple base 25, in a cylindrical fabric dimple 30, has a diameter of nearly the same size as the diameter of the dimple pocket 20 above. An external protrusion may be placed into the planar fabric surface 15 to push and thus extend the fabric. With the external protrusion removed from the fabric and the fabric dimple 10 created, a dimple pocket 20 is formed within the extension of the fabric dimple 10. A dimple entry 22 is the only entry into the dimple pocket 20 from the opposite side of the planar fabric surface 15. The dimple protrusion 9 of the fabric dimple 10 runs from the raised distal end 21 of the fabric dimple 10 to connection with the planar fabric surface 15 at the dimple base 25.

Figure 2B:
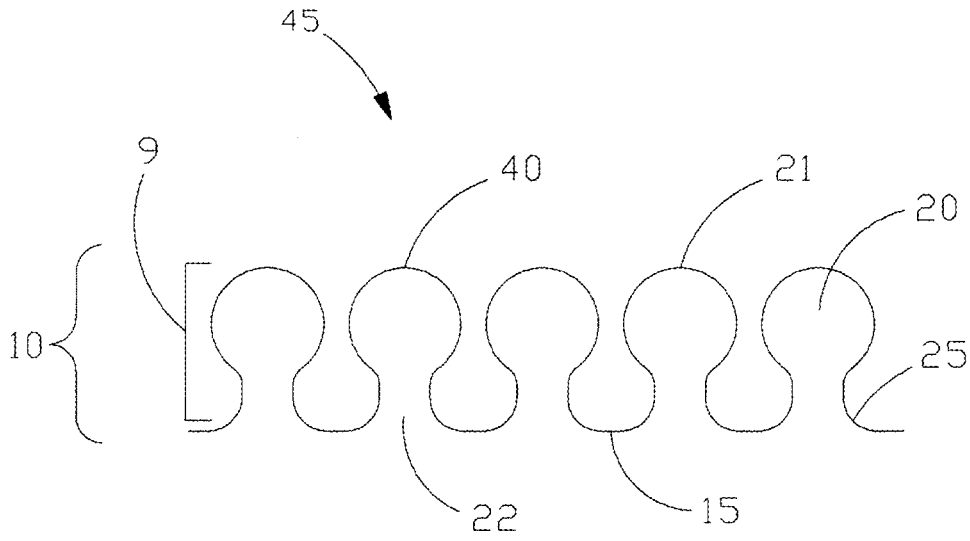
FIG. 2B shows a side view splice of a series of exemplary bubble fabric dimples.

FIG. 2B shows a side view splice of a series of bubble fabric dimples 45 that exemplify either a row or column of bubble fabric dimples 40. The fabric dimple 10 with the recessed base, as shown in FIG. 2B is an example of a bubble fabric dimple 40. The diameter of the dimple base 25 relative to the dimple pocket 20 above is smaller, as shown in FIG. 2B, resulting in the dimple pocket 20 nearly forming a bubble.

Fabric dimples 10 may be in various shapes on the fabric. A fabric dimple 10 may be as-formed. In an as-formed state, the fabric dimple 10 is in the shape as of at the time the fabric dimple 10 is formed, as for instance after an external protrusion is applied. In this shape, the fabric dimple 10 is taut, but is not under tension or being expanded. Thus, the fabric dimples 10 are not wrinkled nor show irregularities in shape. A fabric dimple 10 may be in a relaxed state. In a relaxed state, the fabric dimple 10 is un-stretched and neither under tension nor expanded. The fabric dimple 10 may be shrunken, wrinkled, or may have an irregular shape as compared to the shape of an as-formed state fabric dimple 10. A fabric dimple 10 may also be in an expanded state. In the expanded state, the fabric dimple 10 is stretched, such that the fabric is expanded from a relaxed state, where the fabric is under tension. Fabric dimples 10 may be expanded at the base, may have a shortened height, and may have an irregular shape as compared to the as-formed state or relaxed state shapes for a fabric dimple 10.

Figure 3:
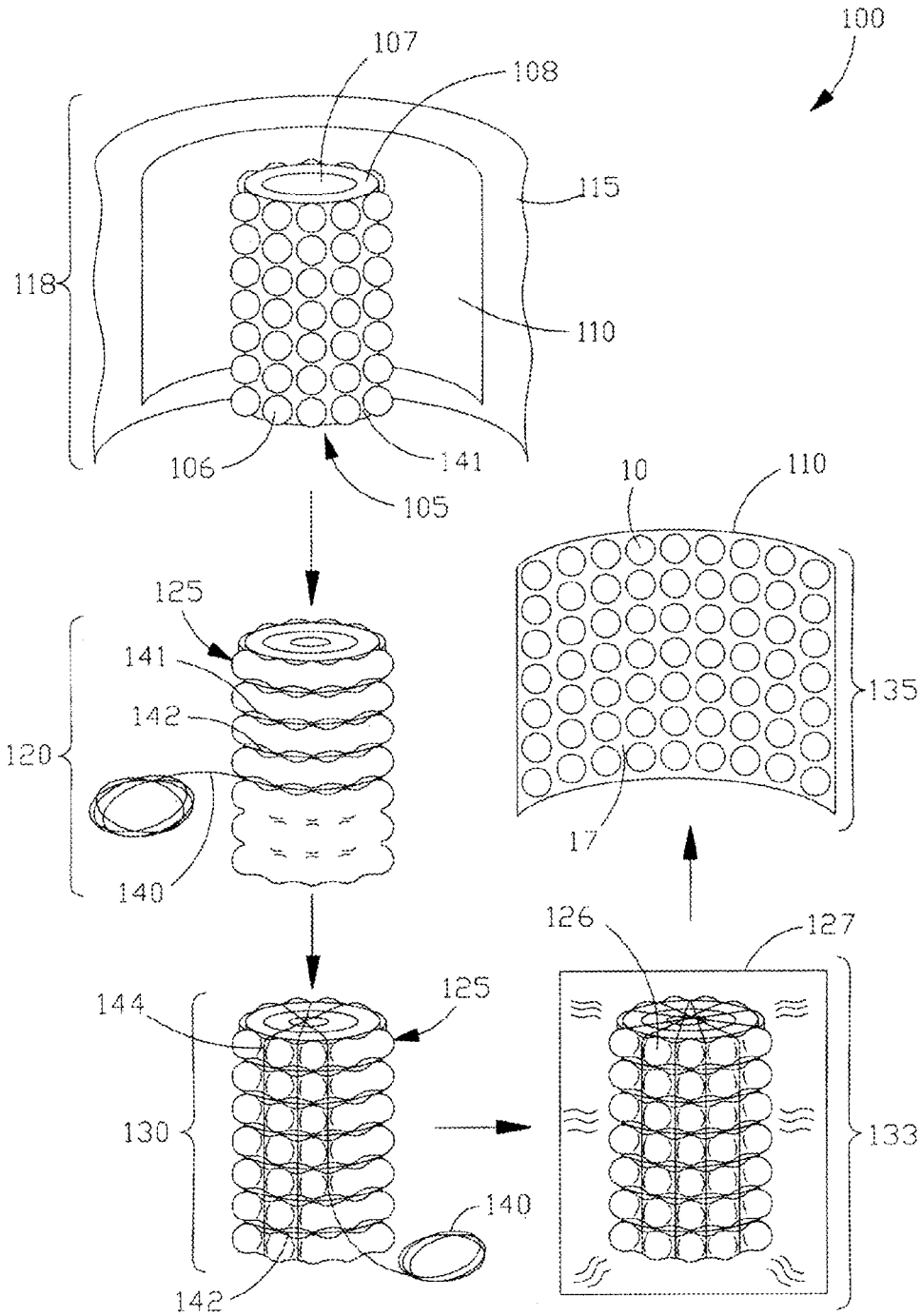
FIG. 3 shows an exemplary process for making reversibly expandable dimpled fabric by heat shrinking in at least one embodiment of the present invention.

FIG. 3 shows a process for making reversibly expandable dimpled fabric by heat shrinking in at least one embodiment of the present invention. The elements utilized in the dimpled fabric shrink process 100 described below, may include a dimple forming mechanism, such as a mold 105, having one or more form protrusions 106, a fabric 110, cord fastener 140, a heat sensitive wrap applicator 115, and heater 127.

At step 118, as shown in FIG. 3, the mold 105 is wrapped by a first layer of fabric 110 and then a second layer of a heat sensitive wrap applicator 115 over top of the fabric 110. Mold 105 may be a variety of shapes. The mold 105 may have one or more form protrusions 106 located any where on the surface of the mold 105. All or a portion of the mold 105 may include one or more form protrusions 106 (e.g., 1-10,000). Artisans will immediately appreciate that all the ranges and values within the explicitly stated ranges are contemplated. Molds 105 may be a cube, sphere, or sheet. In the form of a sheet the mold 105 may be rectangular, square, oval, or the like with form protrusions 106 on one or both sides. In the example of a mold 105 in the shape of a cube it may have form protrusions 106 on one, some, or all six sides of the cube. The mold 105, shown in FIG. 3, is cylindrical. Molds 105 may include a hollow space within. The mold 105 shown in FIG. 3 contains a hollow mold core 107 internally running length wise from one base end of the mold 105 to the other. Hollow space, as for example the hollow mold core 107 shown in FIG. 3, may serve to receive fabric ends of fabric 110. A fabric secure cap 108, shown in FIG. 3, may be lifted from either or both base ends of the mold 105 about the hollow mold core 107 so that fabric ends may be placed in the hollow mold core 107. One or more fabric secure caps 108 are then replaced on either or both base ends of the mold 105 to secure the fabric ends and ultimately the fabric 110 around the mold 105. The hollow mold core 107 may also receive ends of the heat sensitive wrap applicator 115, which may also be secured by the fabric secure cap 108. The hollow mold core 107 may also receive cord fastener 140, described for application in subsequent steps below, to secure the cord fastener 140 within the hollow mold core 107. In other embodiments of the invention, a clip, lock, hook, or other security device may be applied to the mold 105 to secure fabric 110, heat sensitive wrap applicator 115, or cord fasteners 140.

The type of fabric 110 that may be used may be of a fashion customary for fabric uses. Fabric 110 may include bulk fabric, clothing fabric (e.g. shirts), blanket fabric, towel fabric, or fabric associated with banners. Examples of fabric 110 may include, but are not limited to silks, nylons, polyesters, and rayon. For example, polyester may be utilized from post consumer waste, from virgin material, or a combination thereof. Other fabric types, not listed, may too be utilized. The fabric 110 may be reversibly stretchable or not stretchable. Though some elastics may only expand to twice its initial size, fabric 110 utilized in generating a dimpled fabric may expand by a factor of three or more than from its initial size after the dimpled fabric process has concluded. For example, polyester has little elasticity, but the texturing from fabric dimples 10, created through the dimpled fabric shrink process 100, allows the fabric 110 to expand while having material memory for contraction to a smaller size so the fabric 110 may hold shape as for example a gift box. The stretch factor of a fabric 110 will increase as more fabric dimples 10 are created within the fabric 110. So while a particular fabric 110 may have stretch capability by a factor of two, additional fabric dimples will increase the stretch factor capability by more than a factor of two.

The heat sensitive wrap applicator 115 may be an applicator commonly known in the industry such as shrink wrap or shrink film. This type of applicator is typically used to cover items for packaging as included in cartons, boxes, beverage can containers, and pallet loads. A variety of products are typically enclosed with shrink wrap to stabilize the products, unitize the products, keep the products clean, and add a degree of tamper resistance. Material, such as shrink wrap, an example of a heat sensitive wrap applicator 115, is also utilized for covering for some foods such as cheese and meats. Shrink wrap is also utilized to cover boats after manufacture and for winter storage. Heat-shrink tubing, may also be utilized as the heat sensitive wrap applicator 115, and is utilized to seal electric wiring. The heat sensitive wrap applicator 115, such as shrink wrap may be chosen so as to shrink suitably under conditions required to create permanent fabric dimples 10 in the fabric 110 when heated in step 133. In some embodiments of the invention, the heat sensitive wrap applicator 115 may be of the type that shrinks in one direction (unidirectional or mono-directional) or, alternatively, in both directions (bi-directional) when, for example heat is applied to the heat sensitive wrap applicator 115.

At step 120, a wrapped mold 125 is shown including the mold 105 wrapped with the layer of fabric 110 and then the layer of heat sensitive wrap applicator 115. Both the fabric 110 and heat sensitive wrap applicator 115 are secured to the mold 105 with cord fastener 140. The cord fastener 140 secures the heat sensitive wrap applicator 115 to the fabric 110 and to the mold 105 temporarily during parts of the dimpled fabric shrink process 100. Cord fastener 140 may include any one of string, braid, fibrous cords, twine, rope, plastic, natural materials, and/or synthetic materials. The cord fastener 140 may be elastic, as for example made with stretchable rubber, or non-elastic. In other embodiments of the invention, the cord fastener 140 may be a heat-shrinking cord, which provides certain advantages in terms of easier application to the mold 105 and enhanced definition of fabric dimples 10 after the dimpled fabric shrink process 100 has concluded. The enhanced definition may be due to the tightness applied to the mold 105 when the cord fastener 140, made of heat-shrinking cord, shrinks with the increase in temperature applied in step 133 such that the tightness is more exaggerated than if cord is tightened manually by a garment worker. The cord fastener 140 may be wrapped around the mold 105 in grooves 141. Grooves 141 include spaces between the form protrusions 106 along the mold 105 and apparent on the wrapped mold 125 creating un-dimpled portions 17 in the fabric 110 by step 135. The grooves 141 substantially accommodate the cord fastener 140 that is wrapped around the wrapped mold 125, between form protrusion 106, and tightened.

As shown in step 120, the cord fastener 140 is wrapped around the wrapped mold 125 in a horizontal fashion along the grooves 141 to form horizontal fastener bands 142. The cord fastener 140 wrapped and tightened horizontally into the grooves 141 of the wrapped mold 125 results in the horizontal fabric valleys 7 shown in FIG. 1 when the dimpled fabric shrink process 100 is completed. In other embodiments of the invention, cord fastener 140 may be replaced or embedded as seams, sewn or heat bonded into the fabric 110, before or during the dimpled fabric shrink process 100. If for example, the cord fastener 140 is embedded as a seam with a heat-shrinking characteristic, then the seams of the fabric will tighten around the mold 105. Therefore the heat sensitive wrap applicator 115 may be removed from the dimpled fabric shrink process 100 when these types of seams are embedded in the fabric 110.

At step 130, the cord fastener 140 is wrapped around the wrapped mold 125 in a vertical fashion along grooves 141 to form vertical fastener bands 144. The cord fastener 140 wrapped and tightened vertically into the grooves 141 of the wrapped mold 125 results in the vertical fabric valleys 8 shown in FIG. 1 when the popcorn fabric shrink process 100 is completed. Once the wrapped mold 125 is secured by the cord fastener 140 with horizontal fastener bands 142 and vertical fastener bands 144, a secured wrapped mold 126 is created. After the cord fastener 140 has been utilized to wrap the wrapped mold 125, the cord fastener may be tightened and tied internal to the mold 105 in hollow mold core 107 before process at step 133. In some embodiments of the invention, cord fastener 140 may not be utilized thus negating steps 120 and 130. If the cord fastener 140 is not utilized then wrapped mold 125, created in step 118, is processed at step 133. In other embodiments of the invention, either step 120 or step 130 may be negated resulting in a secured wrapped mold 126 having only horizontal fastener bands 142 or vertical fastener bands 144. Application of only horizontal fastener bands 142 or vertical fastener bands 144 may result in elongated, rectangular like fabric dimples 10 such that a column of fabric protrusion 11 or row of fabric protrusions 12 is made of only one fabric dimple 10 (see also FIG. 1). In other embodiments of the invention, step 130 may be conducted before step 120, such that vertical fastener bands 144 are created before horizontal fastener bands 142.

At step 133, the secured wrapped mold 126, or wrapped mold 125 if no cord fastener 140 is applied, is exposed to a heater 127. Heat generated by the heater 127 forces the heat sensitive wrap applicator 115 to shrink and thereby substantially force on and conform the fabric 110 around the form protrusions 106 on the mold 105. The heat process of step 133 includes exposing the fabric 110 to an amount and type of heat suitable to create permanent fabric dimples 10. For example, a suitable amount of heat may be 300° F. over a time period of one hour. A suitable amount of heat may also depend on the type of fabric 110 utilized. The heater 127 may be an oven, heat fan, or any other means to direct heat on the secured wrap mold 126. In other embodiments of the invention, the secured wrapped mold 126 may alternatively be treated in a steam pressure cooker for shrinking the heat sensitive wrap applicator 115, as opposed to using the heater 127. In other embodiments of the invention, both a steam pressure cooker and heater 127 may be utilized.

In some embodiments of the invention, neither a heat sensitive wrap applicator 115 nor a cord fastener 141 may be utilized. For instance, in some embodiments of the invention, the fabric 110 may be applied to the mold 105 and a device, such as a vacuum, may force air out from between the mold 105 and fabric 110 thus fitting the fabric 110 to the mold 105 to create the fabric dimples 10 in the fabric 110.

At step 135, with sufficient amount of time for cooling after heat application in step 133, the secured wrapped mold 126 is unbound from cord fastener 140, if cord fastener 140 was utilized. The heat sensitive wrap applicator 115 is then peeled from the wrapped mold 125 and away from fabric 110. Fabric 110 is then removed from the mold 105. Since the fabric 110 has been closely conformed to the shape of the form protrusions 106 of the mold 105, fabric dimples 10 are permanently formed in the shape of the form protrusions 106. The fabric dimples 10 are simultaneously created with the application of the mold 105, when having two or more form protrusions 106. At step 135, the fabric 110 now having fabric dimples 10, may be further cooled prior to the fabric 110 being utilized.

Figure 4:
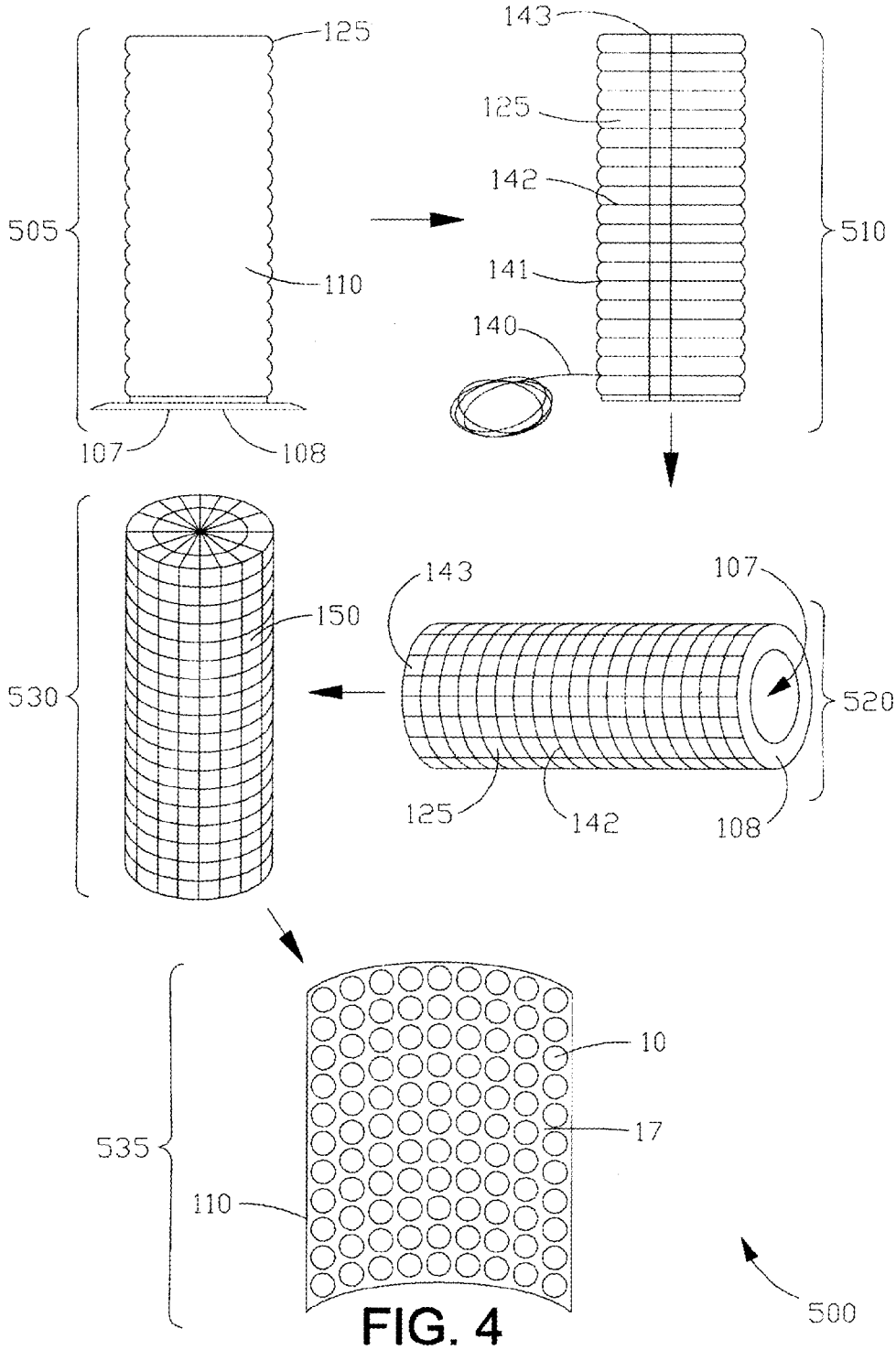
FIG. 4 shows another exemplary process for making reversibly expandable dimpled fabric by binding fabric in at least one embodiment of the present invention.

FIG. 4 shows a process for making reversibly expandable dimpled fabric by binding fabric without application of heat in at least one embodiment of the present invention. Instead of utilizing a heat sensitive wrap applicator 115 with a heater 127 (see FIG. 3), the dimpled fabric binding process 500 utilizes cord fastener 140 for direct application to the fabric 110 to force the fabric 110 into substantial conformance with form protrusions 106 of the mold 105.

At step 505, a wrapped mold 125 is shown. The wrapped mold 125 includes the fabric 110 wrapped around a mold 105 (see FIG. 3). The fabric 110 is secured at the bottom of the wrapped mold 125 by the fabric secure cap 108 securing additional fabric 110 not wrapping the mold 105, as contained in the hollow mold core 107 of the mold 105.

At step 510, cord fastener 140 is directly wrapped around fabric 110 of the wrapped mold 125. As shown, the cord fastener 140 is wrapped horizontally around the wrapped mold 125 to form horizontal fastener bands 142. In one embodiment of the invention, the cord fastener 140 may be wrapped from top to bottom of the wrapped mold 125 in a corkscrew type fashion. In another embodiment of the invention, the cord fastener 140 may be wrapped from bottom to top of the wrapped mold 125. Grooves 141 created by the spacing between form protrusion 106 on the mold 105 receive the cord fastener 140. Cord fastener 140 may be applied vertically to create vertical fastener bands 143. The cord fastener 140 applied vertically criss-crosses perpendicular to cord fastener 140 applied horizontally to form a grid of cord fastener 140 securing the fabric 110 to the mold 105 of the wrapped mold 125.

As step 520, the cord fastener 140 is tightened into the grooves 141. The wrapped mold 125 may then be laid horizontal for access to the hollow mold core 107. Excess cord fastener 140 may be tucked inside the hollow mold core 107 and tied. The fabric secure cap 108 may be removed and reconnected to secure the cord fastener 140 within the hollow mold core 107 and further tighten cord fastener 140 applied on the surface of the wrapped mold 125. In other embodiments of the invention, elastic members may optionally be used to temporarily secure the cord fastener 140 to fit tightly around the wrapped mold 125.

At step 530, the cord fastener 140 secured about the wrapped mold 125 forms a fastened fabric mold 150. The fastened fabric mold 150 may be left in the vertical standing position for the example cylindrical mold, shown in FIG. 4, for a period necessary to provide for permanently formed fabric dimples 10 in the fabric 110. For example, the fastened fabric mold 150 may be left to stand for a few hours or a number of days.

At step 535, when the certain amount of time has passed, the cord fastener 140 is removed from the fastened fabric mold 150. The fabric 110 is then removed from the protrusion mold from 105. Since the fabric 110 has been closely conformed to the shape of the form protrusions 106 of the mold 105, fabric dimples 10 are permanently formed in the shape of the form protrusions 106.

Figure 5:
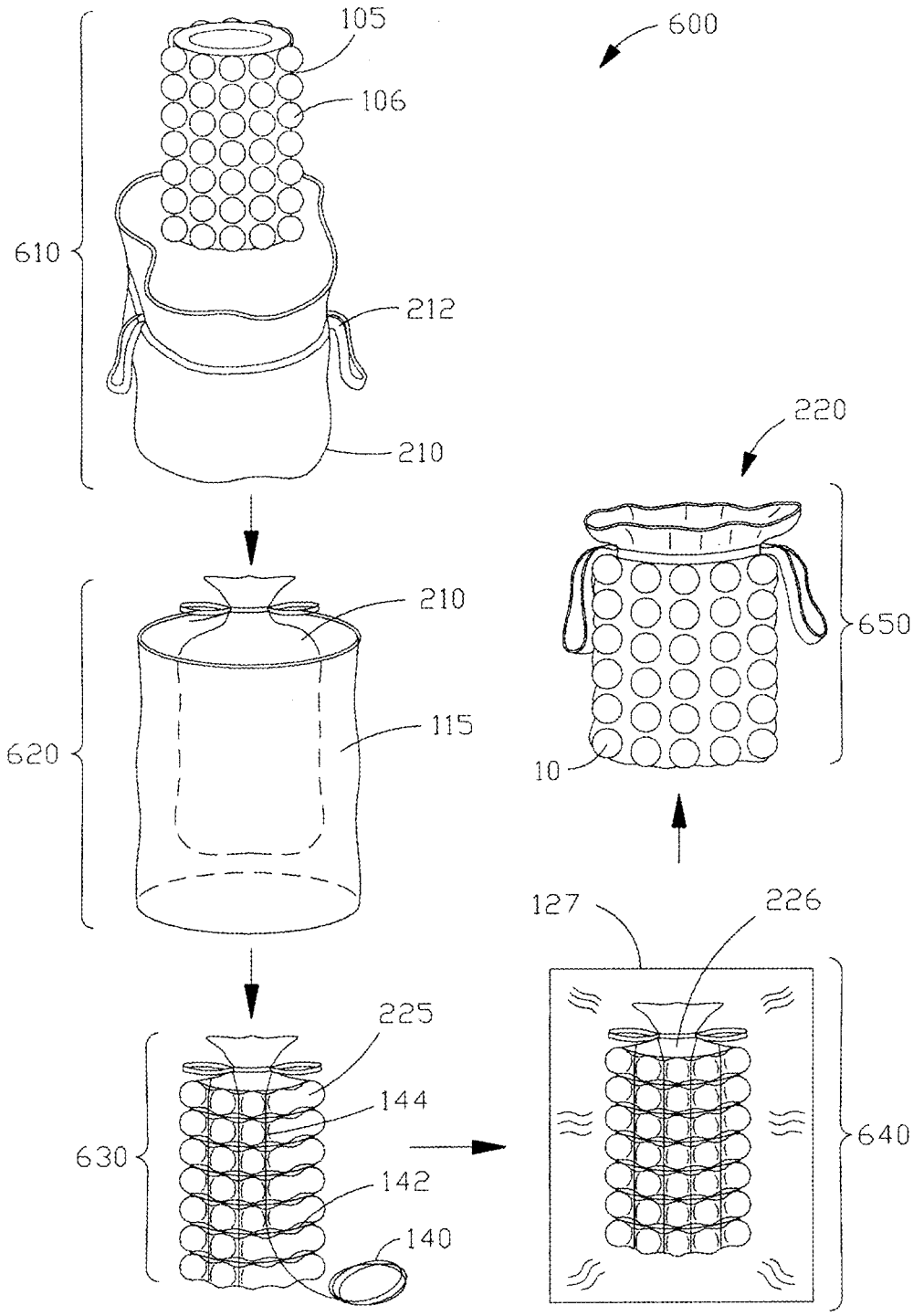
FIG. 5 shows yet another exemplary process for making a reversibly expandable dimpled fabric container by heat shrinking in at least one embodiment of the present invention.

FIG. 5 shows a process for making a reversibly expandable dimpled fabric container by heat shrinking, for use as for example in gift wrapping, in at least embodiment of the present invention. The dimpled fabric container shrink process 600 includes many of the elements utilized and described in reference to the dimpled fabric shrink process 100 shown in FIG. 3. These elements include a mold 105, cord fastener 140 (optional), a heat sensitive wrap applicator 115, and a heater 127. Fabric 110 in the dimpled fabric container shrink process 600 is shaped in the form of a fabric container 210.

The fabric container 210 may resemble a bag or pouch with one opening. The fabric container 210 may have a drawstring 212, located in a channel or passageway around a periphery of the opening of the fabric container 210, for closure. Like the fabric 110, discussed above, the fabric container 210 may be of any type of fabric, including for example, polyester. The fabric container 210 may be tailored to the gift wrapping arts. A fabric container 210 utilized in gift wrapping would allow an average consumer to replace paper wrap thus saving trees or eliminate plastic bags that continuously fill up landfills. Current paper gift wrapping solution results in 2.6 billion dollars worth of wrapping paper being discarded in the United States each year.

In step 610, the mold 105 is inserted in fabric container 210. In other embodiments of the invention, the fabric container 210 may have more than one drawstring. Drawstrings 212 on the fabric container may be pulled tight to close the top of the fabric container 210 and secure the mold 105 within the fabric container 210. The channel or passageway may include one hole, wherein a single drawstring 212 may be pulled to close the opening at the top of the fabric container 210. In other embodiments of the invention, the channel may include two holes, so that one or more drawstrings 212 may be pulled to close the opening at the top of the fabric container 210. Two drawstrings 212 may be interlapped so that by pulling both drawstrings in opposing directions, as for example outside two oppositely located holes on the channel around the periphery of the opening, the diameter of the loop created by the interlap in the two drawstrings shrinks to close the opening at the top of the fabric container 210. In other embodiments of the invention, four, six, or more drawstrings may be interlapped so as to create the same tightening effect. In other embodiments of the invention, two drawstrings may be exposed at holes oppositely located on the channel around the periphery of the opening, but connected within the channels by heat-sealed edging. The drawstrings may be pulled from the holes, thus crimping or shrinking the heat-sealed edging between the drawstrings to close the opening at the top of the fabric container 210.

In step 620, the fabric container 210 containing the mold 105 within, is inserted into a heat sensitive wrap applicator 115. The heat sensitive wrap applicator 115 may be preformed to receive the fabric container 210, containing the mold 105, so that the fabric container 210 may fit inside the heat sensitive wrap applicator 115 to form a fabric container wrapped mold 225. In other embodiments of the invention, the heat sensitive wrap applicator 115 may be wrapped from a sheet of heat sensitive wrap applicator 115 around the fabric container 210 to create the fabric container wrapped mold 225.

In step 630, cord fastener 140 is wrapped around the fabric container wrapped mold 225. Applying the cord fastener 140 creates either or both horizontal fastener bands 142 and/or vertical fastener bands 144. A fabric container secured wrapped mold 226 is created after the cord fastener 140 is applied. In other embodiments of the invention, a cord fastener 140 may not be applied to the fabric container wrapped mold 225.

At step 640, the fabric container secured wrapped mold 226, or fabric container wrapped mold 225 if no cord fastener 140 is applied, is exposed to a heater 127. Heat generated by the heater 127 forces the heat sensitive wrap applicator 115 to shrink and thereby substantially conform the fabric container 210 around the form protrusions 106 on the mold 105. The heat process of step 640 includes exposing the fabric container 210 to an amount and type of heat suitable to create permanent fabric dimples 10 on the fabric container 210. For example, a suitable amount of heat may be 300° F. over a time period of one hour. A suitable amount of heat may also depend on the type of fabric utilized in the fabric container 210. The heater 127 may be an oven, heat fan, or any other means to direct heat on the heat sensitive wrap applicator 115. Heat alone can set the popcorn detail, for the fabric dimples 10, into the fabric. There is no need to apply the fabric container 210 to a bath solution to soften the garments prior to heating. Bathing can be eliminated as the gift wrap does not need to have the same softness as a blouse, wherein a solution may be applied to soften the fabric. Using heat alone eliminates a need to dry the fabric products saving both time and energy in the production process, thereby saving money. In other embodiments of the invention, the fabric container secured wrapped mold 226, or fabric container wrapped mold 225 may alternatively be treated in a steam pressure cooker for shrinking the heat sensitive wrap applicator 115, as opposed to using the heater 127. In other embodiments of the invention, both a steam pressure cooker and heater 127 may be utilized.

At step 650, with sufficient amount of time for cooling after heat application in step 640, the cord fastener 140 is unbound from the fabric container secured wrapped mold 226, if cord fastener 140 was utilized. The heat sensitive wrap applicator 115 is then peeled from the fabric container wrapped mold 225. The mold 105 is then removed from the inside of the created dimpled fabric container 220. Since the dimpled fabric container 220 has been closely conformed to the shape of the form protrusions 106 of the mold 105, fabric dimples 10 are permanently formed in the shape of the form protrusions 106. At step 650, the dimpled fabric container 220, having fabric dimples 10, may be further cooled prior to utilization.

The dimpled fabric container 220 shown at step 650 in FIG. 5 may be utilized for gift wrapping. The expandable fabric of the dimpled fabric container 220 provides an advantage for both reduced or enlarged storage volume. In use, an object, package, or gift may be placed inside the dimpled fabric container 220 while the fabric of the dimpled fabric container 220 is stretched as needed to accommodate the package. The reversibly elastic nature of the dimpled fabric container 220, elastic due to the dimpled fabric container shrink process 600 and in particular the heat applied within the process 600 to form the fabric dimples 10, provides for the dimpled fabric container 220 to close up around the contents within. Thus, the effect resembles wrapping of contents as opposed to placement of contents in a container resembling a sack. The fabric dimples 10 in the dimpled fabric container 220 allow for the fabric to return to a smaller and more condensed shape to fit around the content, such as a gift. This in effect minimizes any sagging in the dimpled fabric container 220 around the article placed within the dimpled fabric container 220. A benefit of the dimpled fabric container 220 is that a wide range of various sized and shaped contents or articles, such as gifts, may be covered with a minimum number of dimpled fabric container 220 sizes.

In some embodiments of the invention, the dimpled fabric container 220 has storable volume within a dimension of between about 1 and about 500 cubic centimeters (cc). Artisans will immediately appreciate that all the ranges and values within the explicitly stated ranges are contemplated, e.g., from about 5 to about 20 cc. In some embodiments of the invention, the dimpled fabric container 220 is expandable by a factor of greater than two or more. Again, artisans will immediately appreciate that all the ranges and values explicitly stated are contemplated, including for example, an expansion factor of twenty, thirty, or fifty times. Moreover, the combination of storage and stretch may be mixed and matched as desired, so for example a storage volume of about 5 cc is expandable fifty times to a volume of about 250 cc. The size and/or shape of fabric dimples 10 created on a dimpled fabric container 220 may directly impact the expandability of the dimpled fabric container 220. For example, the fabric container 220 may be more expandable having the same number of larger fabric dimples 10 compared to the same number of smaller fabric dimples 10.

In some embodiments of the invention, the dimpled fabric container 220 may have a graphic sown, pressed, painted, or silk screened, such as to create for example a pattern. The graphic may be applied to the fabric container 210 either before or after the dimpled fabric container shrink process 600 is conducted. A graphic may also be applied to the fabric 110 either before or after the dimpled fabric shrink process 100 or dimpled fabric binding process 500. Patterns such as embroidery may be sewn into fabric of the dimpled fabric container 220 by hand, with mechanical assistance, or by full automation. Patterns may also be achieved by dying the fabric of the dimpled fabric container 220. The dimpled fabric container 220 may contain a musical card or chip, similar to a musical greeting card, that may be recordable for applying voice or music.

Figure 6A:
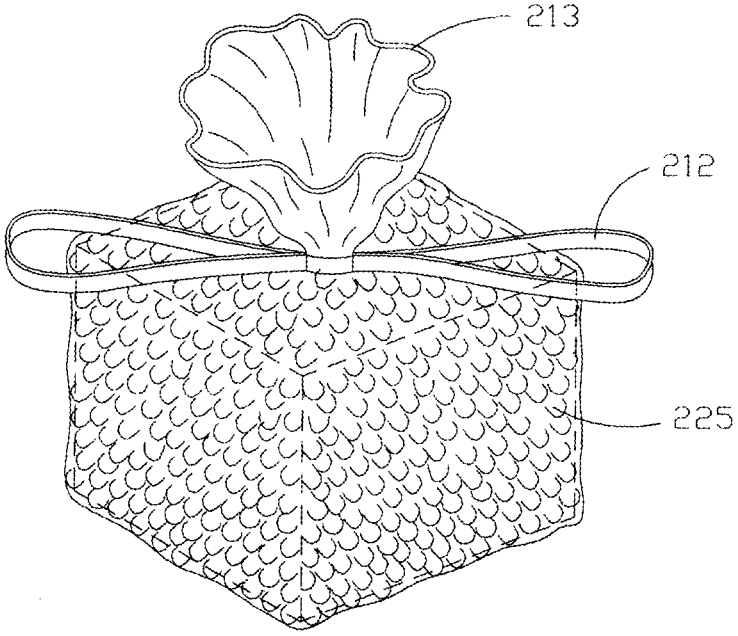
FIG. 6A shows a dimpled fabric pouch in at least one embodiment of the present invention.

The dimpled fabric container 220 for gift wrapping may also resemble a pouch, or cinch bag, looking like gift wrap when closed and tightened around contents within. FIG. 6A shows an exemplary dimpled fabric container 220 for gift wrapping utilizing a pouch. A dimpled fabric pouch 225 is particularly durable since no seam needs to be introduced at the bottom the fabric container 210 for the dimpled fabric container shrink process 600. Dimpled fabric pouches using heat sealed seams rather than sewn seams allow the order of the current steps of production to flip so that an entire bolt of fabric can have dimples applied at once, prior to the making of individual products. The fabric dimpled pouch 225 may have a portion containing one or more fabric dimples 10 and a portion of the dimpled fabric container 220 may not have any fabric dimples 10. As shown in FIG. 6A, fabric dimples 10 may be located on the one or more sides and/or the bottom of the fabric dimpled pouch 225. Like the dimpled fabric container 220 shown in FIG. 5, the fabric dimpled pouch 225 may have drawstrings 212 to provide for closure. Buttons, snaps, ribbon, double drawstring, zip lock, zipper, or other suitable means for closing an opening may be utilized with the dimpled fabric pouch 225. An unopened dimpled fabric pouch 225 may resemble a specific shape such as a dragon or any other real or imaginary figure.

Figure 6B:
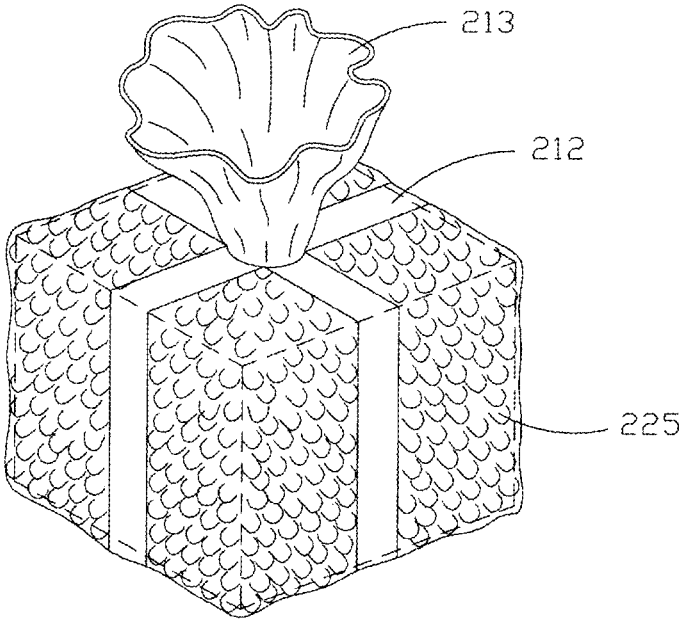
FIG. 6B shows a dimpled fabric pouch wrapped with a draw string in at least one embodiment of the present invention.

The dimpled fabric pouch 225 may also contain a smooth fabric portion 213, having no dimpled textures. In other embodiments, the fabric portion 213 may have dimples. The smooth fabric portion 213 may be positioned at the top of the dimpled fabric pouch 225, providing the dimpled fabric pouch 225 with a gift-like appearance. The drawstring 212, located in a channel or passageway around a periphery of the opening of the dimpled fabric pouch 225, may be pulled outwards and away from the pouch 225 at two opposing openings in the passageway to close the opening of the pouch 225 and tighten the base of the smooth fabric portion 213. A consumer may choose to tie a bow using the drawstrings 212 or apply draw ribbons to create a bow on the dimpled fabric pouch 225. The drawstring 212 or draw ribbon may be wrapped around the dimpled fabric pouch 225, as shown in FIG. 6B, and then arranged or organized so that the pouch 225 resembles a gift. Surplus drawstring 212 or draw ribbon may be rolled and stuffed back into the dimpled fabric pouch 225, with a final result of a gift wrap over the contents, in the shape of a gift box. Velcro, snaps, ties, and other fastening devices may be used to close the dimple fabric pouch 225, fasten a ribbon to the dimple fabric pouch 225, attach a card to the dimpled fabric pouch 225, or provide other benefit.

The benefit of fabric texturing due to fabric dimples 10 on the dimpled fabric pouch 225 allows for the dimpled fabric pouch 225 to be crumbled, smashed, or folded, but still retain a clean wrapping presentation when placed on a gift. Utilizing a dimpled fabric pouch 225 or other type of dimpled fabric container 220 for gift wrap requires no scissors, tape, rolls of paper and little time expenditure. The dimpled fabric pouch 225 provides for a small storage footprint.

By applying a mold 105 to the processes described above, as opposed to the conventional process of hand tying a portion of the fabric 110 for each fabric dimple 10, more creative, complex, and/or intricate fabric dimples 10 may be created. A mold 105 may contain form protrusions 106 (see FIG. 3) that are more complicated than form protrusions 106 used to create cylindrical fabric protrusion 30 in FIG. 2A or bubble fabric protrusions 40 in FIG. 2B. A complicated form protrusion 106 may be created or sculpted and then fabricated numerous times so as to have exact copies of the same form protrusion 106 located on a mold 105. In other embodiments of the invention, several varying shape and size form protrusions 106 may be located on the same mold 105. Thus, fabric dimples 10 may be formed as complex, three dimensional shapes, wherein the raised distal end 21 and dimple pocket 20 (see FIGS. 2A and 2B) may form complex shapes.

To generate, for example, varying fabrics 110, dimpled fabric containers 210, or dimpled fabric pouches 225, with varying locations, shapes, and sizes of fabric dimples 10, various types of molds 105 may be constructed or other devices utilized. Form protrusions 106 on the mold 105 may be arranged in arrays, wherein the form protrusions 106 may be in fixed positions, as for example in rows and columns, or they may be arranged randomly. Form protrusions 106 on the mold 105 may be formed into various complex shapes. For example, form protrusions 106 may be created to form the various shaped fabric dimples 10 shown in FIGS. 7A-E. The form protrusions may be more complicated replicating, for example, figures, geometric shapes, letters, or numbers. The form protrusions 106 may be formed by carving, sculpting, molding, or by application of compound to the surface of the mold 105 (e.g. dripping plastic to grow the mold). Form protrusions 106 may be created, by sculpting a mold 105. Cutting away at portions of the mold 105 in this instance create the grooves 141 around the form protrusions 106. In another example, form protrusions 106 may be created by dripping, for example, plastic to the surface of the mold 105, thus raising form protrusions 105 from the surface of the mold 105. Form protrusions 106 may be arranged in any pattern relative to grooves 141 on the surface of the mold 105. Form protrusions 106 may be arranged in rows, columns, or in any random configuration. Grooves 141 may be of any length or width and may in themselves form shapes and/or other designs between the form protrusions 106.

A form protrusion 106 located on the surface of mold 105 typically has a base connected to the surface of the mold 105. At least one sidewall extends from the base of the form protrusion 106 to a top end portion of the form protrusion 106 at a distal end from the at least one side wall opposing the base of the form protrusion 106. The surface layer of the distal end of the form protrusion 106 may be formed into the various shapes and patterns for form protrusion 106 as described above.

Figure 7A:
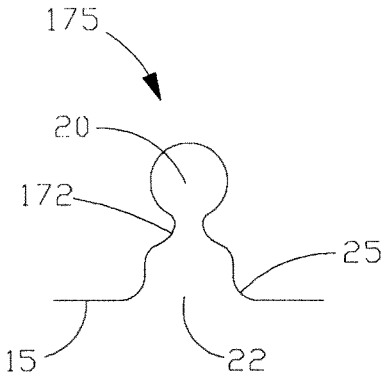
FIG. 7A shows a side view splice of an individual first variation fabric dimple in at least one embodiment of the present invention.

FIG. 7A shows a side view splice of an individual first variation fabric dimple 175. The invention provides for the creation of fabric dimples 10 with distinct features. This first variation fabric dimple 175 has a dimple neck 172 located within the dimple pocket 20. A portion of the pocket 20 has a reduced cross-sectional area relative to, and above, the dimple entry 22 at the dimple base 25. The term "above" in the context of being above the dimple base 25 or protrusion entry 22 refers to a position deeper within the dimple pocket 20 relative to the dimple base 25, as shown in FIG. 7A.

Figure 7B:
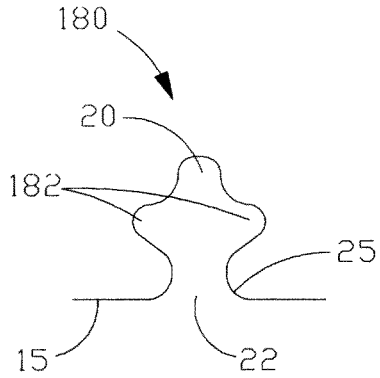
FIG. 7B shows a side view splice of an individual second variation fabric dimple in at least one embodiment of the present invention.

FIG. 7B shows a side view splice of an individual second variation fabric dimple 180. FIG. 7B shows the dimple pocket 20 with an additional bulge 182 to the left and right, thus increasing the cross-sectional area of the dimple pocket 20 at the additional bulges 182 relative to the dimple entry 22.

Figure 7C:
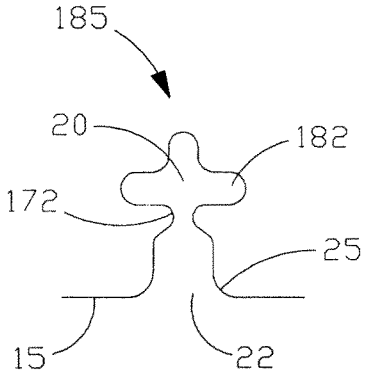
FIG. 7C shows a side view splice of an individual third variation fabric dimple in at least one embodiment of the present invention.

FIG. 7C shows a side view splice of an individual third variation fabric dimple 185. FIG. 7C shows the dimple pocket 20 with an additional bulge 182 to the left and right and a dimple neck 172 just below the additional bulges 182.

Figure 7D:
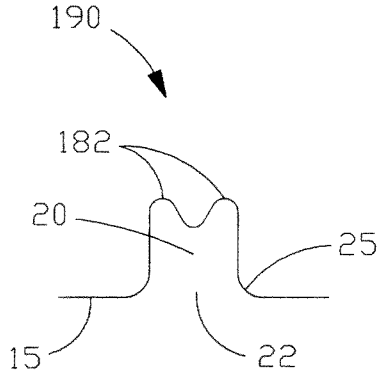
FIG. 7D shows a side view splice of an individual fourth variation fabric dimple in at least one embodiment of the present invention.

FIG. 7D shows a side view splice of an individual fourth variation fabric dimple 190. FIG. 7D shows the dimple pocket 20 with two additional bulges 182 extending upward above the dimple pocket 20.

Figure 7E:
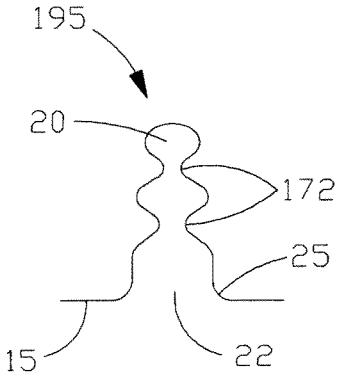
FIG. 7E shows a side view splice of an individual fifth variation fabric dimple in at least one embodiment of the present invention.

FIG. 7E shows a side view splice of an individual fifth variation fabric dimple 195. FIG. 7E shows the dimple pocket 20 with two dimple necks 172, one above the other in the dimple pocket 20.

Embodiments of the invention, utilizing a mold 105 with varied shape form protrusions 106 may result in fabric dimples 10 having such varied shapes and sizes. These shapes may include geometrical shapes such as, but not limited to, cones, spheres, portions of a sphere, cubes, or pointed cylinders. Further examples of shapes may include but are not limited to animals, plants, or humanoid characters such as fish, dinosaurs, birds, dogs, palm trees, leaves, persons, or celebrity faces. Further example shapes may include letters, numbers, or words.

Figure 8:
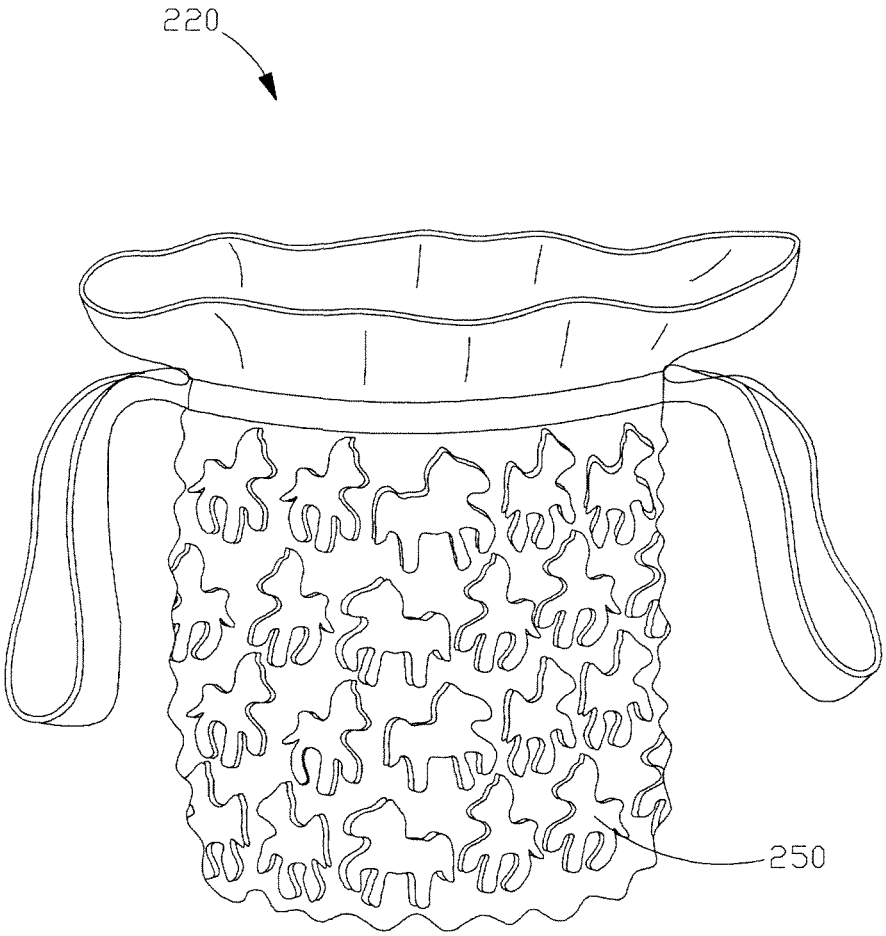
FIG. 8 shows a dimpled fabric container having animal fabric dimples according to one embodiment of the present invention.

FIG. 8 shows a dimpled fabric container 220 having animal-shaped fabric dimples 250 according to one embodiment of the present invention. In this particular example, the animal-shaped fabric dimples 250 are of ponies. A mold 105 may be configured with pony shaped form protrusions 106 such that after, for example, the dimpled fabric container shrink process 600 is conducted, as shown in FIG. 5, animal fabric dimples 250 in the shape of ponies are depicted on the outside of the dimpled fabric container 220.

Figure 9:
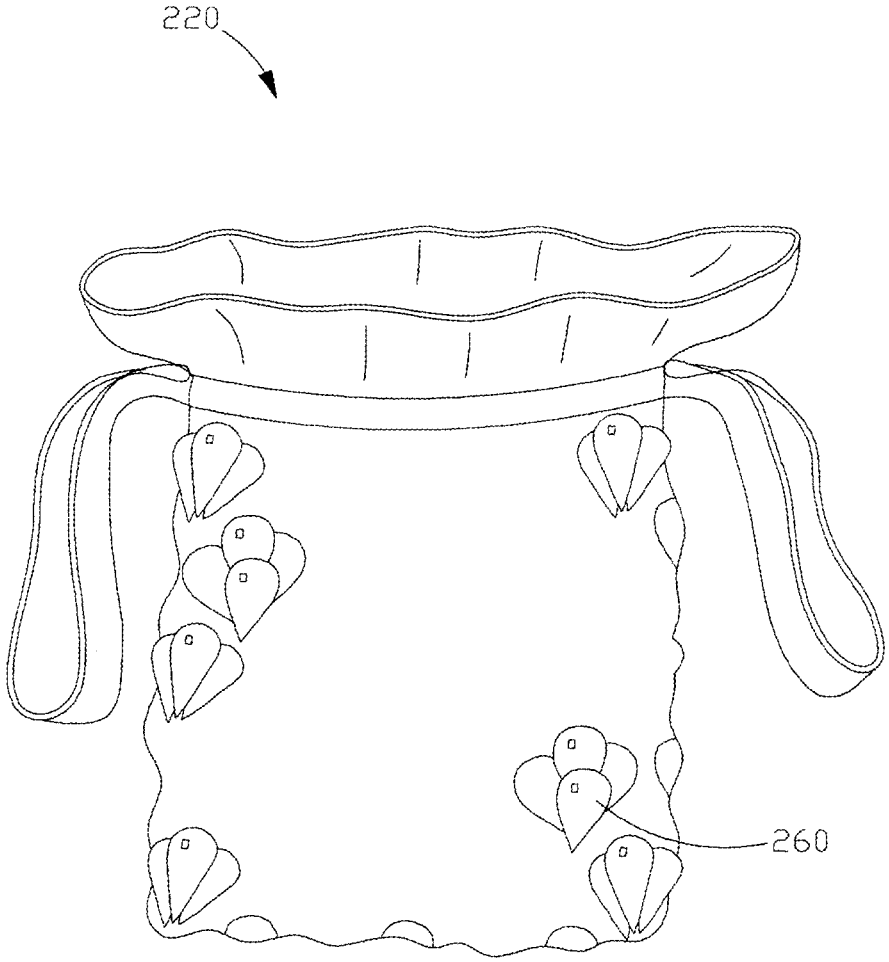
FIG. 9 shows a dimpled fabric container having balloon fabric dimples according to one embodiment of the present invention.

FIG. 9 shows a dimpled fabric container 220 having balloon-shaped fabric dimples 260 according to one embodiment of the present invention. A mold 105 may be configured with balloon shaped form protrusions 106 such that after for example, the dimpled fabric container shrink process 600 is conducted, as shown in FIG. 5, balloon fabric dimples 260 are depicted on the outside of the dimpled fabric container 220.

Figure 10:
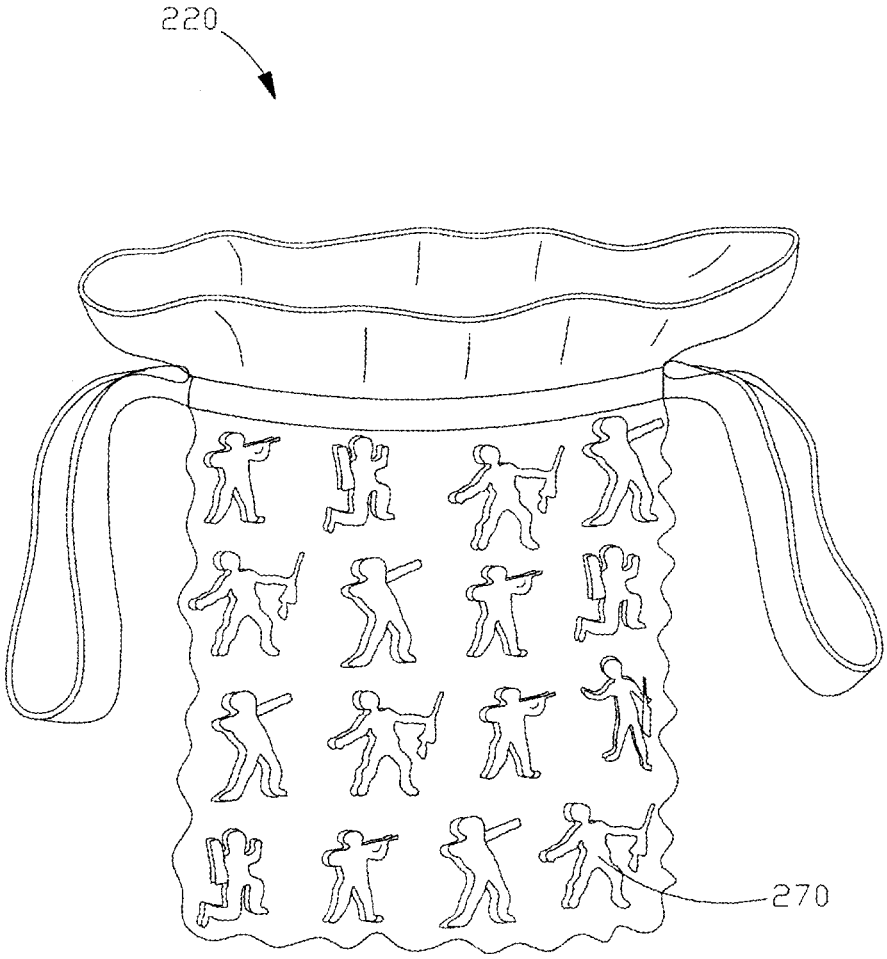
FIG. 10 shows a dimpled fabric container having humanoid fabric dimples according to one embodiment of the present invention.

FIG. 10 shows a dimpled fabric container 220 having humanoid-shaped fabric dimples 270 according to one embodiment of the present invention. In this particular example, the humanoid-shaped fabric dimples 270 are of soldiers. A mold 105 may be configured with soldier shaped form protrusions 106, in various stances or with various equipment, such that after for example, the dimpled fabric container shrink process 600 is conducted, as shown in FIG. 5, humanoid-shaped fabric dimples 270 in the shape of soldiers, in various stances or with various equipment, are depicted on the outside of the dimpled fabric container 220.

Figure 11:
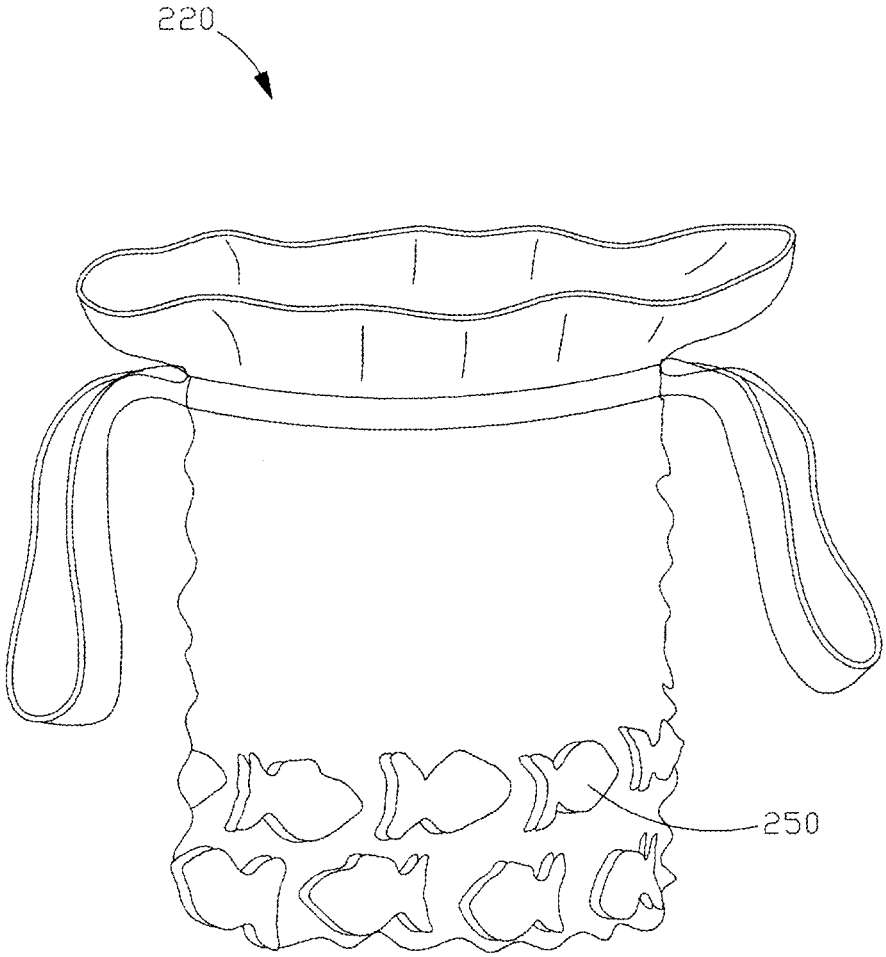
FIG. 11 shows a dimpled fabric container having another type of animal fabric dimples according to one embodiment of the present invention.

FIG. 11 shows a dimpled fabric container 220 having animal-shaped fabric dimples 250 according to one embodiment of the present invention. In this particular example, the animal-shaped fabric dimples 250 are of fish. A mold 105 may be configured with a fish shaped form protrusions 106 such that after for example the dimpled fabric container shrink process 600 is conducted as shown in FIG. 5, animal fabric dimples 250 in the shape of fish are depicted on the outside of the dimpled fabric container 220.

Figure 12:
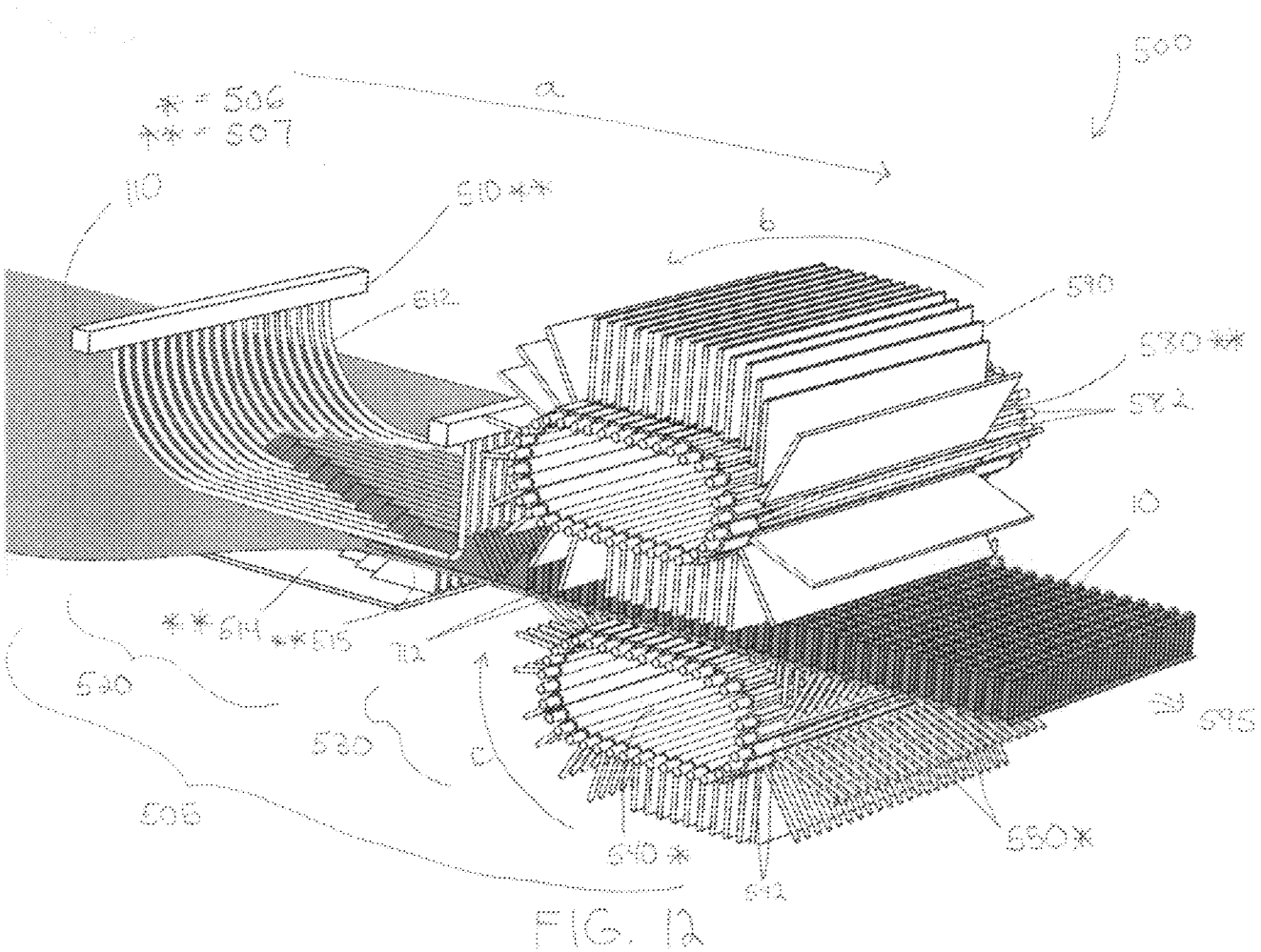
FIG. 12 shows a perspective view of a process for making reversibly expandable dimpled fabric by utilizing a fabric dimple press machine in one embodiment of the present invention.

FIG. 12 shows a perspective view of a process for making reversibly expandable dimpled fabric by utilizing a fabric dimple press machine 505 in one embodiment of the present invention. The elements utilized in the dimpled fabric machine press process 500 described below, may include fabric 110, heater 127, and the fabric dimple press machine 505. In the illustrated embodiment, the fabric dimple press machine 505 includes a dimple forming mechanism 506 and a fitting device 507. In one embodiment, the dimple forming mechanism 506 includes the protrusion rotary belt 540 and protrusions 550 and the fitting device 507 includes a ribbed grate 510, a ridge platform 514 having vertically raised ridges 515, and a blade rotary belt 580.

At step 520, as shown in FIG. 12, fabric 110 is fed into the fabric dimple press machine 505 in direction a. The fabric 110 may be fed automatically, due to the rotation of the blade rotary belt 580 and protrusion rotary belt 540 in the fabric dimple press machine 505, and/or pulled by a garment worker through the machine 505. The fabric 110 enters the fabric dimple press machine 505 through a ribbed grate 510. The fabric 110 passes through the ribbed grate 510 and over a ridge platform 514 having vertically raised ridges 515 extending up from ridge platform 514. Each ridge 515 fits between and extends through a pair of ribs 512 of ribbed grate 510. The ridges 515 may be of various heights as extending through the ribbed grate 510.

Figure 13:
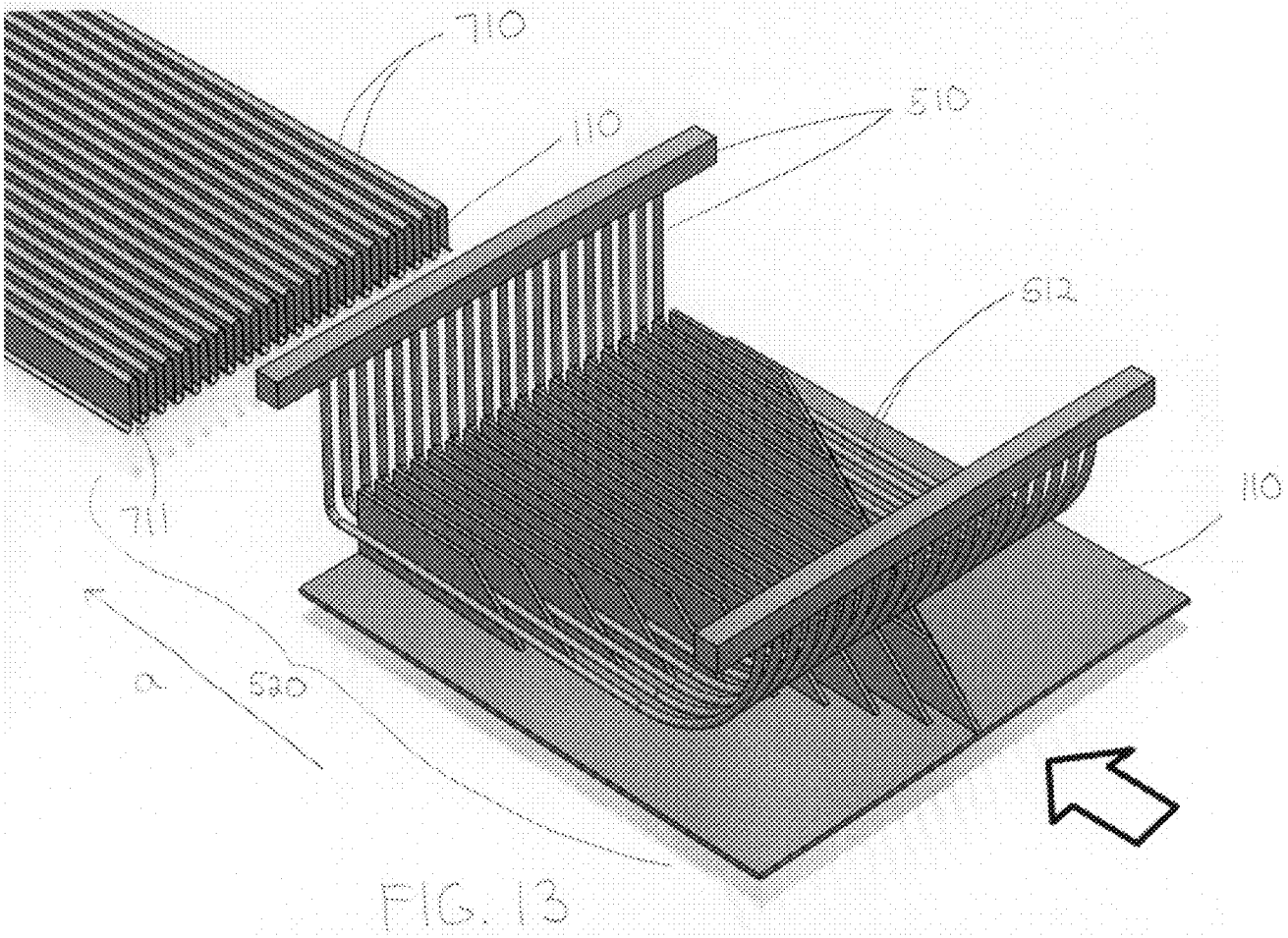
FIG. 13 shows a reverse perspective view of fabric entering and exiting a ribbed grate of a fabric dimple press machine in one embodiment of the present invention.

FIG. 13 shows a reverse perspective view of fabric 110 entering and exiting the ribbed grate 510 of the fabric dimple press machine 505. The fabric 110 is fed through the ribbed grate 510 in direction a. The fabric 110 slides over the ridges 515 extending vertically between the ribs 512 of the ribbed grate 510. The fabric 110 conforms over the ridges 515 as between the ribs 512 of the ribbed grate 510. As the fabric 110 exits the ribbed grate 510 in direction a, the fabric 110 contains vertical fabric folds 710 due to conformance with the ridges 515 extending through the ribs 512 of the ribbed grate 510. The vertical fabric folds 710 contain vertical fabric channels 711 where the ridges 515 once occupied the space in the vertical fabric folds 710. The vertical fabric folds 710 are repeated over the cross-sectional surface area of the fabric 110 as shown in FIG. 13.

Referring again to FIG. 12, at step 530, the fabric 110, having vertical fabric folds 710, is fed between a blade rotary belt 580 and a protrusion rotary belt 540. The protrusion rotary belt 540 contains protrusion rows 542, linked about the belt 540 to rotate with the belt 540, having individual machine protrusions 550 located on and extending from the surface of the protrusion row 542. The protrusion rotary belt 540 rotates in direction c, as shown in FIG. 12. The number of machine protrusions 550 placed about each row 542 on the protrusion rotary belt 540 equates to the number of ridges 515 extending vertically from the ridge platform 514. The machine protrusions 550 located on the protrusion rotary belt 540 are aligned with the ridges 515 on the ridge platform 514 so that the machine protrusions 550 rotate about the vertical fabric folds 710 into the vertical fabric channels 711, thus maintaining the shape of the fabric 110, with vertical fabric folds 710, as the fabric exits the ribbed grate 510. In other embodiments of the invention, some protrusion rows 542 on the protrusion rotary belt 540 may have no machine protrusions 550. In other embodiments of the invention, some protrusion rows 542 may have less machine protrusions 550 than the number of ridges 515 on the ridge platform 514.

The blade rotary belt 580 rotates in direction b. The blade rotary belt 580 contains blade rows 582, linked about the belt 580 to rotate with the belt 580, having a single blade 590 located on and extending from the surface of each blade row 582. In some embodiments, a blade row 580 may have more than one blade 590 or no blades. The blade rotary belt 580 and protrusion rotary belt 540 rotate simultaneously and at the same speed. In other embodiments of the invention, the blade rotary belt 580 and protrusion rotary belt 540 may rotate at different speeds. For example, the blade rotary belt 580 may rotate at half the speed of the protrusion rotary belt 540.

As the machine protrusions 550 enter the vertical fabric channels 711, moving from the ribbed grate 510, blades 590 fall in position between the protrusion rows 542 and between the machine protrusion 550 located inside the vertical fabric channels 711. The blades 590 inserted into the fabric 110, having the vertical fabric channels 711 with machine protrusions 550 located within, fits the fabric between the protrusion rows 542 thus creating horizontal fabric channels 712. The horizontal fabric channels 712 may be pressed by the blade 590 so that fabric 110 is compressed at the base of each horizontal fabric channel 712. In other embodiments of the invention, the blade 590 may include a sharp edge to sever the horizontal fabric channels 712. The fabric 110, sectioned by the inclusion of machine protrusions 550 into the vertical fabric folds 710 and fit to form around the machine protrusions 550 by the insertion of blades 590, now contains created fabric dimples 10. The fabric 110, having fabric dimples 10, exits from between the blade rotary belt 580 and protrusion rotary belt 540.

At step 595, the fabric 110 exiting the fabric dimple press machine 505, and having fabric dimples 10, may be compressed relative to direction a. The compressed or uncompressed fabric 110 may then be heat treated with heater 127 (see FIG. 3). In other embodiments of the invention, the fabric 110 may not be heat treated. If the fabric 110 is heat treated, then a sufficient amount of time should pass before utilizing the fabric 110 with fabric dimples 10.

Figure 14:
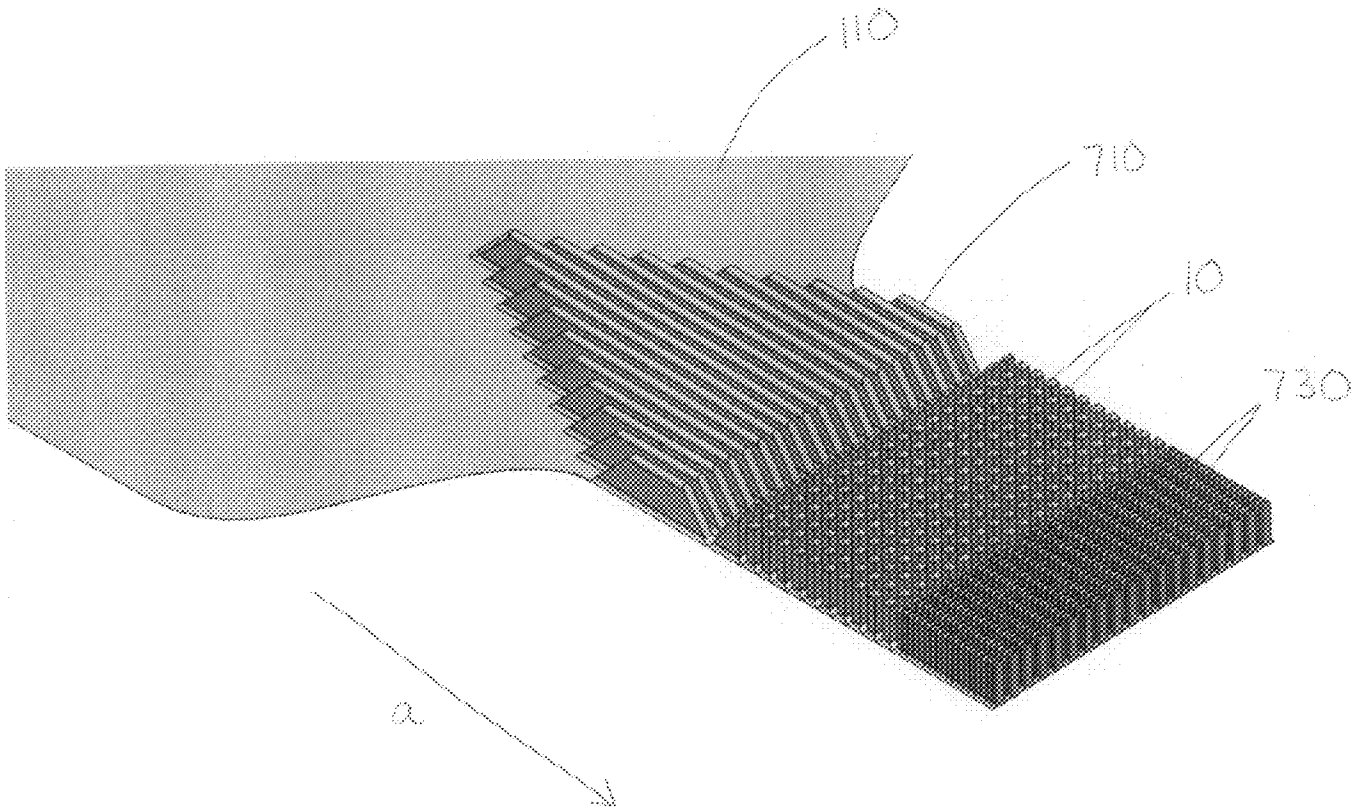
FIG. 14 shows a perspective view of fabric being shaped as passed through the fabric dimple press machine in one embodiment of the present invention.

FIG. 14 shows a perspective view of fabric being shaped as passed through the fabric dimple press machine 505. As described above, the fabric 110 is shaped by the ribbed grate 510 and ridges 515 to form the vertical fabric folds 710. Location of the machine protrusions 550 into the vertical fabric channels 711 and the insertion of blades 590, creating horizontal fabric channels 712 in the vertical fabric folds 710, results in the fabric dimples 10. Varied sized dimples 10 may be created when the blade rotary belt 580 is rotated faster or slower than the protrusion rotary belt 540. In other embodiments of the invention, varied sized dimples 10 may be formed by implementing smaller or larger machine protrusions 550. Varied sized dimples 10 may also be formed by utilizing thicker or thinner blades 590 with smaller or larger machine protrusions 550. Other variations to the shape and size of the machine protrusions 550 or blades 590, the width or number of protrusion rows 542 or blade rows 582, and/or speed adjustments to either the blade rotary belt 580 or protrusion rotary belt 540 may result in variances of the size and shape of fabric dimples 10 in the fabric 110. The machine protrusions 550 may also include various shapes, including geometric shapes, animal shapes, humanoid shapes, letters, numbers, or other types of shapes. The ribs 512, ridges 515, or blades 590 may be adjusted and/or altered to form the fabric around the machine protrusions 550 such that the fabric dimples 10 take a specific shape. Compressed dimples 730 are also shown in FIG. 14, wherein the compression may be applied by a machine or other device in a direction opposite direction a, the direction of the fabric 110 entering and exiting the fabric dimple press machine 505. In other embodiments of the invention, fabric 110 may simply be laid across a press. Either the top or bottom of the press may contain protrusions, and the other side (e.g. top or bottom) of press conformed such that the protrusions are aligned to fit within. This would generate dimples in a bolt of fabric 110, as the press is enclosed over the fabric 110.

Although the invention has been described with reference to exemplary embodiments, it is not limited thereto. Those skilled in the art will appreciate that numerous changes and modifications that may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A dimpled fabric generation system comprising:

a dimple forming mechanism comprising a plurality of protrusions on and extending from a surface of the dimple forming mechanism, wherein the protrusion comprises a base in contact with the surface of the dimple forming mechanism, at least one side wall extending from the base, and a top end portion located at a distal end of the at least one side wall;

a fabric to position on at least a portion of the surface of the dimple forming mechanism and at least a portion of the plurality of protrusions on the at least a portion of the surface of the dimple forming mechanism;

a fitting device to apply the fabric to the dimple forming mechanism, wherein the fitting device fits the fabric on to the surface of the dimple forming mechanism and around the at least a portion of the plurality of protrusions of the dimple forming mechanism;

wherein the dimple forming mechanism comprises a rotary belt having the plurality of protrusions extending radially from the rotary belt, and the fitting device comprises:

a blade rotary device;

a plurality of ribs; and one or more ridges; and wherein the blade rotary device feeds the fabric under the plurality of ribs and over ridges to create folds in the fabric and the blade rotary device compresses the fabric positioned over the plurality of protrusions perpendicular to the direction of the folds to conform the fabric around the plurality of the protrusions.

* * * * *